US005598894A

United States Patent [19]

Burleson et al.

[11] Patent Number: 5,598,894

[45] Date of Patent: Feb. 4, 1997

[54] SELECT FIRE MULTIPLE DRILL STRING TESTER

[75] Inventors: John D. Burleson, Denton; Flint R. George, Flower Mound; Justin L. Mason, Denton, all of Tex.

[73] Assignee: Halliburton Company, Dallas, Tex.

[21] Appl. No.: 498,312

[22] Filed: Jul. 5, 1995

[51] Int. Cl.[6] ..... E21B 29/02; E21B 43/117; E21B 43/1185

[52] U.S. Cl. ..... 175/4.52; 166/55.1; 166/297; 175/4.54

[58] Field of Search ..... 175/4.52, 4.54; 166/55, 55.1, 297, 63, 264, 142, 191

[56] References Cited

U.S. PATENT DOCUMENTS

| | | | |
|---|---|---|---|
| 3,612,189 | 10/1971 | Brooks et al. | 166/55.1 X |
| 4,560,000 | 12/1985 | Upchurch | 166/55.1 X |
| 4,612,992 | 9/1986 | Vann et al. | 175/4.54 X |
| 4,619,333 | 10/1986 | George | 175/4.54 X |
| 5,103,912 | 4/1992 | Flint | 175/4.52 X |
| 5,287,924 | 2/1994 | Burleson et al. | 166/297 |
| 5,355,957 | 10/1994 | Burleson et al. | 166/297 |

*Primary Examiner*—Stephen J. Novosad
*Attorney, Agent, or Firm*—William M. Imwalle; Paul I. Herman; Daniel F. Perez

[57] ABSTRACT

A system is provided for selectively perforating multiple zones in a well either simultaneously, or in series, having isolation barriers, or packers, located between the perforating multiple zones, without moving the system with respect to the well. The system includes a tubing string which carries at least a first and a second perforating gun. At least a first and a second pressure actuated firing head are associated with the first and second perforating guns, respectively. A first and second packer for isolating the perforating guns from each other. A source of actuating fluid pressure for the firing head is provided, which may be the bore of the tubing string. A first selective communication device is provided for isolating the second firing head from the source of actuating fluid pressure until after the first perforating gun has been fired, and for then communicating the second firing head with the source of actuating fluid pressure in response to firing of the first perforating gun.

25 Claims, 8 Drawing Sheets

SELECT FIRE MULTIPLE DRILL STRING TESTER

BACKGROUND OF THE INVENTION

1. Field of the Invention

The present invention relates to the field of well perforating.

2. Description of the Prior Art

During the completion of an oil or gas well, a length of casing is cemented in a borehole, and then one or more zones of the casing are perforated to communicate the bore of the casing with subsurface geological formations intersected by the borehole so that oil or gas from that subsurface formation may be produced by the well.

One well-known type of perforating system is a tubing conveyed perforating system wherein the perforating guns and related apparatus are carried by a tubing string made up of a plurality of threaded joints of tubing or pipe which are connected together and lowered into the well. These tubing conveyed completion systems may be run in combination with a drill stem test string so that the well can be perforated and tested in a single trip.

In some situations, it is desirable to be able to selectively perforate more than one zone of the well at different times. The prior art has typically addressed this need by the provision of multiple firing heads which are constructed to actuate at different operating pressures. With these systems, the selection of the appropriate firing head and gun to be fired is determined by the pressure which is applied to the tubing string or the well annulus to actuate the firing head. Systems of this type capable of firing several perforating guns independently during one trip into the well can be constructed utilizing the Time Delayed Firing Head available from Halliburton Energy Services. The Halliburton Time Delayed Firing Head utilizes a set of shear pins the number of which can be selected to determine the actuating pressure of each firing head.

Two recent patents assigned to the assignee of the present invention relate to systems for selective perforation of a well in multiple zones. Those patents are U.S. Pat. No. 5,287,924 issued on Feb. 22, 1994, entitled, "Tubing Conveyed Selective Fired Perforating Systems," and U.S. Pat. No. 5,355,957 issued on Oct. 18, 1994, entitled, "Combined Pressure Testing and Selective Fire Perforating Systems," both having common inventors to the subject invention.

SUMMARY OF THE INVENTION

The present invention provides a tubing conveyed selective fired perforating system for selectively perforating multiple zones of a well having isolation barriers, or packers, located between the multiple perforating guns to permit selective perforation of the zones either simultaneously, or in series, without moving the system with respect to the well. In addition, the present invention discloses the use of a selective perforation system in conjunction with a selective drill string testing system.

The system includes a tubing string carrying at least a first and a second perforating gun. At least a first and a second pressure actuated firing head are associated with the first and second perforating guns, respectively.

A source of actuating fluid pressure for the firing heads is provided. The source is preferably either the tubing bore of the tubing string or the well annulus surrounding the tubing string.

A first packer is provided for isolating the first and second perforating gun by being connected to the tubing string between the first and second perforating guns and selectively set within the bore of the well. In addition, a second packer is connected above the second perforating gun, and likewise, selectively set within the bore of the well.

When operating the perforating guns in a series, a first selective communication means is provided for isolating the second firing head from the source of actuating fluid pressure until after the first perforating gun has been fired, and for then communicating the second firing head with the source of actuating fluid pressure in response to firing of the first perforating gun.

Additional selective communication means can be provided to allow for firing of additional perforating guns selectively in sequence.

The selective communication means preferably is a select fire sub including a housing having a first chamber defined therein. The first chamber is communicated with the second firing head. A supply passage is communicated with the source of actuating fluid pressure and extends into the housing. The supply passage is initially isolated from the first chamber. An explosive means is contained in a second chamber of the housing for perforating a portion of the housing and thereby communicating the supply passage with the first chamber. An actuating means fires the explosive means of the select fire sub in response to firing of the first perforating gun.

In an alternative embodiment, the perforating guns can be operated simultaneously, rather than in series as described above.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

For a more complete understanding of the present invention, including its features and advantages, reference is now made to the detailed description, taken in conjunction with the accompanying drawings of which.

DETAILED DESCRIPTION OF THE PREFERRED EMBODIMENTS

Figure 1:
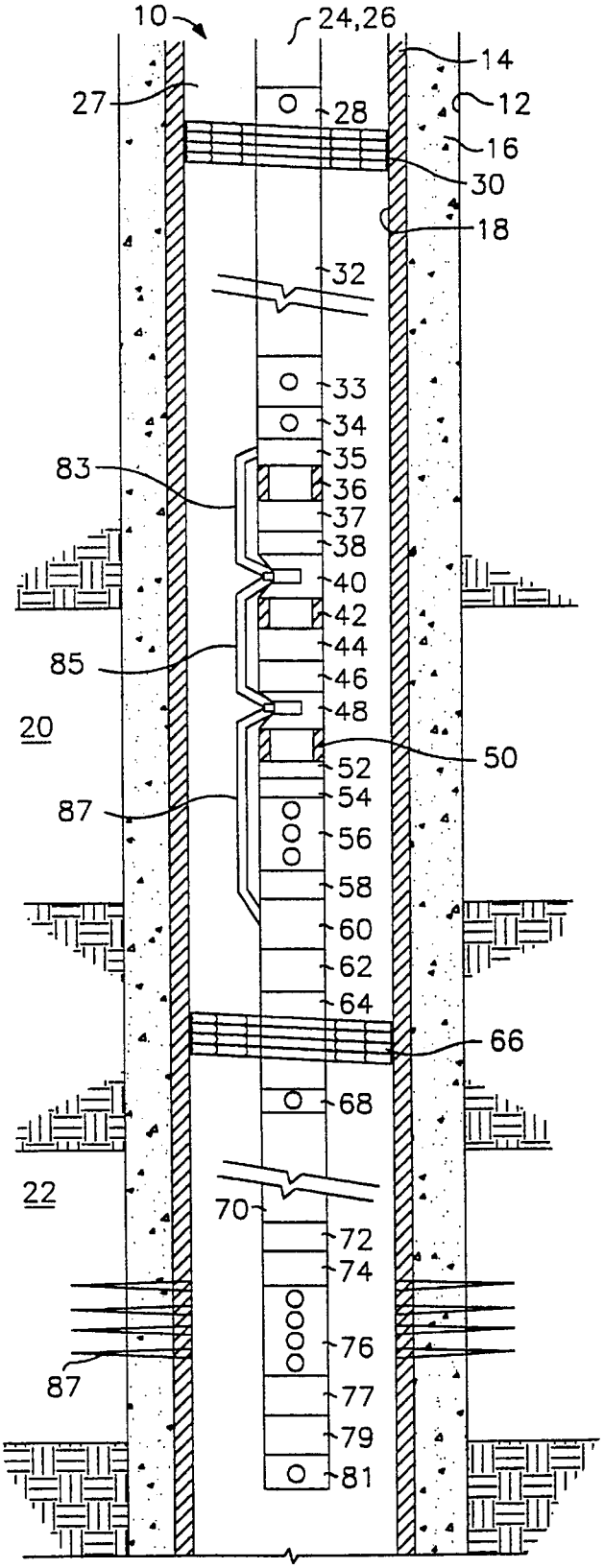
FIG. 1 is an elevation schematic view of a first embodiment of the select fire multiple drill string tester system of the present invention shown in place in a well which intersects a plurality of subsurface geological formations which are to be perforated.

Turning now to the drawings, and particularly to FIG. 1, a well is shown and generally designated by the numeral 10. The well 10 is formed by drilling a borehole 12 into the ground and then placing a casing 14 within the borehole 12 and cementing the casing in place with cement 16. The casing 14 has a casing bore 18. The borehole 12 intersects one or more subsurface geological formations such as 20 and 22 which are to be perforated for testing and/or production of the well from those zones.

A perforating string 24 is shown in place in the well 10. The perforating string 24 of the present invention may also be referred to as a tubing conveyed selective fired perforating system 24. A well annulus 27 is defined between the casing bore 18 and the perforating string 24.

The system 24 provides a means by which a plurality of perforating guns can be selectively fired so as to selectively perforate multiple zones of the well 10 such as the zones 20 and 22 illustrated in FIG. 1.

The system 24 includes a tubing string 26 which carries on its lower end a string of tools which beginning from top to bottom include a first annular pressure crossover assembly 28, a packer 30, tubing 32, a pressure operated vent assembly 33, an annulus pressure crossover assembly 34, a control line sub 35, a first air chamber 36, a first pressure activated firing head 37, a first crossover 38, which connects firing head 37 to a first select fire sub 40, a second air chamber 42, a second pressure activated firing head 44, a second crossover sub 46, a second select fire sub 48, a third air chamber 50, a third pressure activated firing head 52, a third crossover sub 54, a first perforating gun 56, a fourth crossover sub 58, a circulating valve 60, a slip joint 62, a safety joint 64, a second packer 66, a perforated sub 68, tubing 70, a fourth pressure activated firing head 72, a fifth crossover sub 74, a second perforating gun 76, a sixth crossover sub 77, a fifth pressure activated firing head 79, and a ported sub 81.

It will be understood that each of the perforating guns schematically illustrated in FIG. 1 may be made up of many individual gun segments connected together in series to provide the proper length of gun to perforate the zone in question.

The annulus pressure crossover assembly 34 is communicated with the first select fire sub 40 by the first control fluid conduit portion 83. The conduit 83 may be ¼ inch O.D. stainless steel tubing. The first select fire sub 40 is communicated to the second select fire sub 48 by a second control fluid conduit portion 85. The second select fire sub 48 is communicated to the circulating valve 60 by a third control fluid conduit portion 87.

The system 24 is constructed for use with packers 30 and 66 and is arranged to fire the perforating guns 56 and 76 selectively in sequence from the bottom up. That is, the first gun to fire will be second gun 76. The next gun to fire will be first gun 56. The system 24 may also fire the perforating guns 56 and 76 simultaneously.

To selectively perforate multiple zones such as zones 20 and 22 of the well 10 with the system 24, the procedure is carried out as follows. System 24 is lowered into the casing bore 18 of well 10 placing first perforating gun 56 adjacent to first subsurface zone 20 and placing second perforating gun 76 adjacent to second subsurface zone 22.

The firing heads 37, 44, 52, 72 and 79 preferably are Time Delay Firing Heads available from Halliburton Energy Services. These firing heads employ a time delay fuse. The use of the time delay fuse allows for ample time, on the order of five to seven minutes, to bleed the actuating pressure off the tubing string 26 prior to the time the associated perforating gun fires. The operating pressure of the firing head 79 is determined by selection of the number of shear pins utilized to hold a firing piston in place initially against the differential pressures acting there across.

Figure 2:
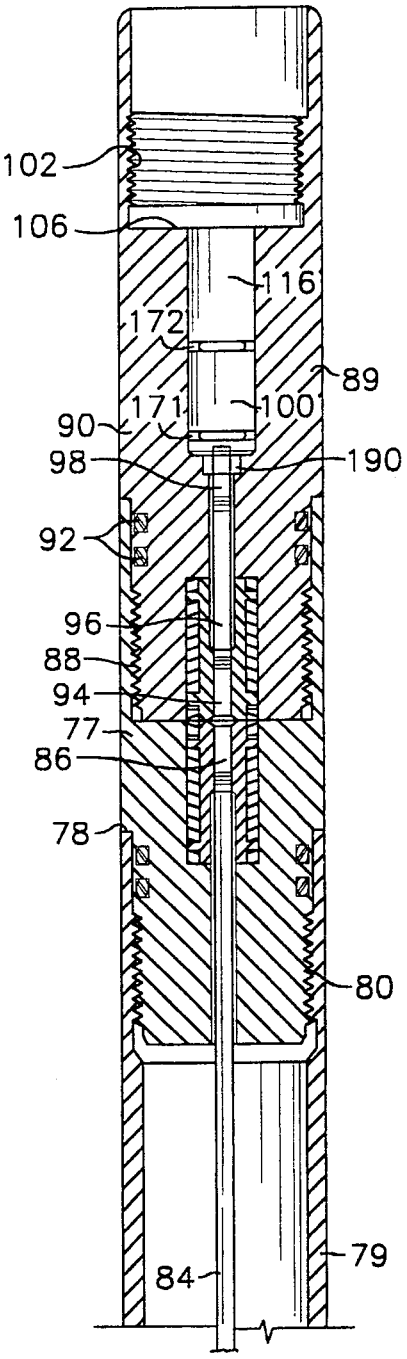
FIG. 2 is an elevation sectioned view showing the details of construction of an isolation sub assembly utilized in the system FIG. 1.

As seen in FIG. 2, an alternative embodiment of the present invention can be seen which reflects the use of an isolation sub. Specifically, an upper end 78 of second perforating gun 76 is threadedly connected at 80 to a crossover sub 77. A detonating cord 84 extends from the upper end of perforating gun 79 through the crossover sub 77 where it terminates in a booster charge 86. The crossover sub 77 and components contained therein may be considered to be a portion of the fifth perforating gun 79.

The crossover sub 77 is connected at thread 88 to a delay housing 90 of isolation sub 89 with O-ring seals 92 being provided therebetween.

The delay housing 90 carries a booster charge 94 at its lower end which is fired by the booster charge 86. The booster charge 94 in turn ignites a length of detonating cord 96 which leads to a third booster charge 98 which fires a gun delay/isolation device 100.

The upper end portion of delay housing 90 has internal threads 102 which are joined to external threads 104 of the fourth pressure activated firing head 72. As will become apparent when viewing FIG. 3, the orientation of the crossover sub may be inverted.

Figure 3:
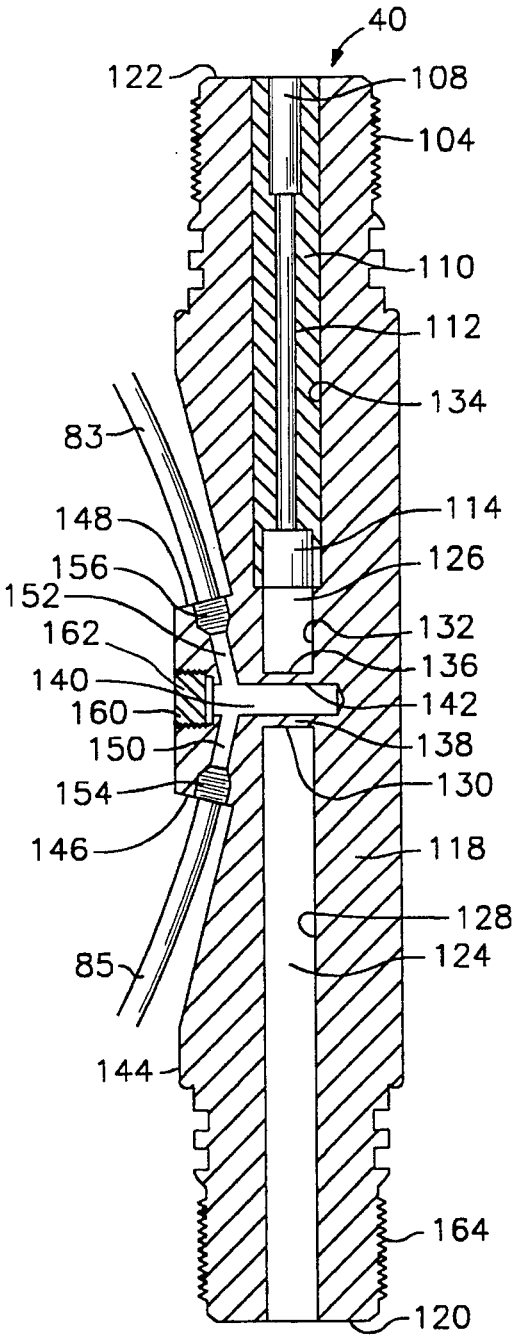
FIG. 3 is an elevation sectioned view showing the details of construction of a select fire sub utilized with the system of FIG. 1.

Now referring to FIG. 3, a drawing represent in first select fire sub 40 is depicted. The booster charge 108 is contained in a cylindrical insert 110 which carries the booster 108, a length of detonating cord 112, and a shaped charge 114.

The upper end first select fire sub 40 has external threads 104 which are joined to internal threads 102 of a delay housing 90 similar to that pictured in FIG. 2, so that a lower end 106 of gun delay/isolation device 100 abuts a booster charge 108 received in the first select fire sub 40. The booster 108 is contained in a cylindrical insert 110 which carries the booster 108, a length of detonation cord 112, and a shaped charge 114.

The gun delay/isolation device 100 when fired by the booster 98 will in turn fire the booster 108, but at the same time will prevent fluid communication through a bore 116 of delay housing 90 thereby maintaining the first perforating gun 34 isolated from the select fire sub 38. The gun delay/isolation device 100 works in the following manner.

Figure 4:
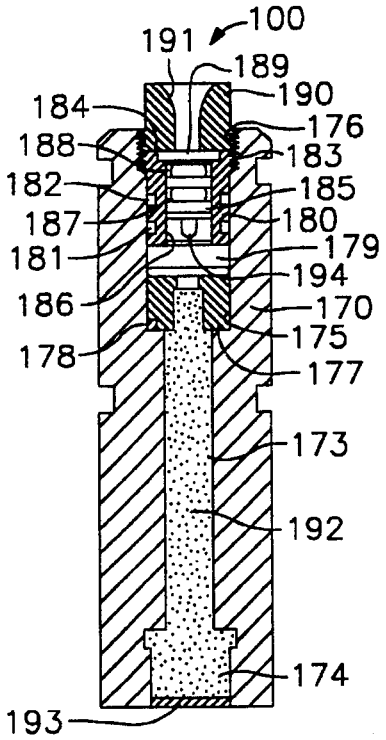
FIG. 4 is an enlarged sectioned view of the gun delay/isolation device used in the isolation sub of FIG. 2.

As seen in FIG. 4, which is an enlarged sectioned view of the gun delay/isolation device 100, device 100 includes a housing 170 received in bore 116 with O-ring seals 171 and 172 received therebetween. Housing 170 has a bore 173, lower counterbore 174, upper counterbore 175, and upper threaded counterbore 176 defining a central passage therethrough.

Upper counterbore 175 has an annular spacer 177 received therein abutting shoulder 178. Located above spacer 177 is a primer cap 179.

Located above primer cap 179 is a piston sleeve 180 carrying O-rings 181 and 182 which seal against counterbore 175. Piston sleeve 180 is threaded at 183 adjacent its upper end 184. Thread 183 is received in threaded counterbore 176 to hold piston sleeve 180 in place.

A piston 185 is received in a bore 186 of piston sleeve 180 with two O-rings 187 and 188 therebetween. Piston 185 has a radially outward extending flange 189 at its upper end which is larger in diameter than bore 186 and initially holds piston 185 in the position shown.

An annular retainer ring 190 is threadedly received in threaded counterbore 176 above piston 185 to prevent upward movement of piston 185.

Retainer ring 190 has booster 98 (see FIG. 2) received in a bore 191 thereof.

Below primer cap 179 the bore of spacer 177 and the bore 173 and counterbore 174 of housing 170 are packed with an explosive mixture 192 which is held in place by a thin retainer disc 193 received in the lower end of lower counterbore 174.

When booster 98 detonates, the high pressure generated thereby pushes down on piston 185 shearing the radial flange 189. Piston 185 travels downward within bore 186 a short distance until firing pin 194 of piston 185 strikes primer cap 179 detonating the same. The detonation of primer cap 179 detonates the explosive material 192 which will rupture disc 193 and in turn detonate booster 108 (see FIG. 3). The burning of explosive mixture 192 will also provide a short time delay in this explosive chain reaction.

The piston 185 remains sealed in bore 186 of piston sleeve 180, thereby preventing any fluid pressure communication through the device 100.

The device 100 is itself a part of the prior art and is constructed in accordance with the teachings of U.S. Pat. No. 5,078,210 to George, the details of which are incorporated herein by reference.

The select fire sub 40 is shown in detail in FIG. 3. Select fire sub 40 includes a cylindrical housing 118 which can be described as having first and second ends 120 and 122 which may also be referred to as lower and upper ends 120 and 122 in the orientation shown in FIG. 3.

The housing 118 of select fire sub 40 has first and second axially extending chambers 124 and 126 defined therein and communicated with the first and second ends 120 and 122, respectively, of housing 118. The first chamber 124 is defined by a bore 128 which has a blind end 130. The second chamber 126 is defined by a bore 132 and a counterbore 134. The bore 132 has a blind end 136.

The blind ends 130 and 136 of chambers 124 and 126 are separated by a wall 138 of housing 118.

The housing 118 has an actuating pressure supply passage 140 defined therein. Supply passage 140 includes a lateral bore 142 extending laterally into the wall 138 between the blind ends 130 and 136 of first and second chambers 124 and 126.

Housing 118 includes a cylindrical outer surface 144 having first and second recesses 146 and 148 defined therein on opposite sides longitudinally of the lateral bore 142.

The actuating pressure supply passage 140 further includes first and second branch passages 150 and 152 communicating the lateral bore 142 with the first and second recesses 146 and 148, respectively. Each of the branch passages 150 and 152 includes an internally threaded outermost portion such as 154 and 156 which provides a means for connection thereof to a control fluid conduit such as first control fluid conduit portion 83 which extends into the first recess 148 and second control fluid conduit portion 85 which extends into the first recess 146.

It is noted that for the configuration as shown in figure FIG. 1 which is shown in detail in FIG. 3, the threaded outer portion 160 of lateral bore 142 is blocked by a threaded plug 162.

The lower portion of select fire sub 40 carries external threads 164 which are connected to the second air chamber 42 seen in FIG. 1.

Figure 5A:
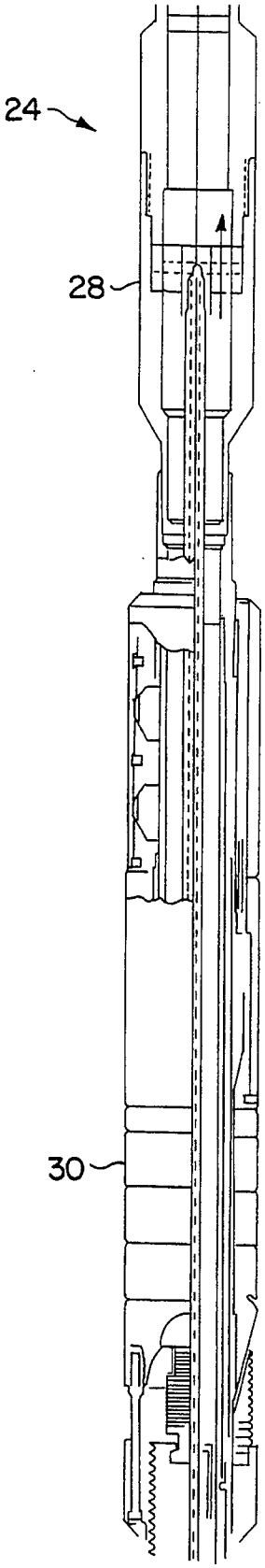
FIGS. 5A–5K are elevation sectioned views showing the details of construction of the select fire multiple drill string tester system of FIG. 1.
Figure 5B:
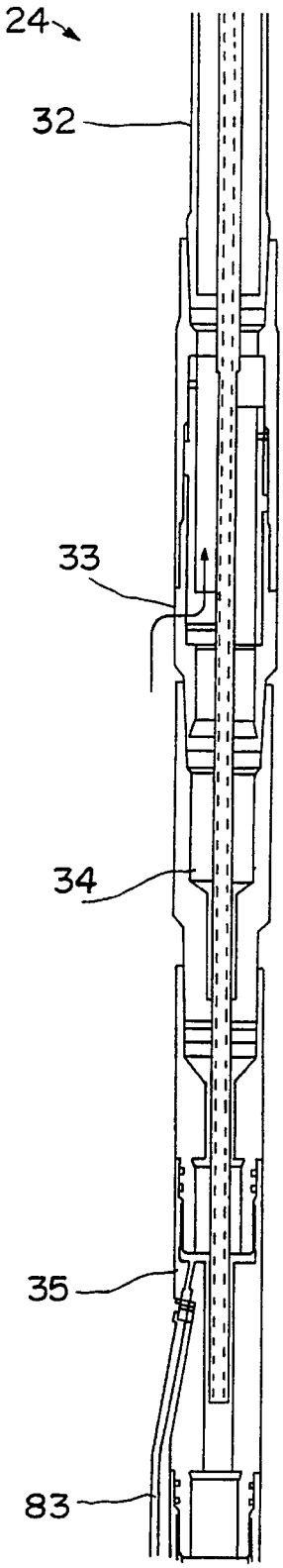

Referring now to FIGS. 5A–K, drawing depicting the details of construction of the select fire multiple drill string tester system of the present invention are shown. FIG. 5A depict an upper section of system 24 including a first annular pressure crossover assembly 28 and a packer 30. FIG. 5B shows tubing 32, a pressure operated vent assembly 33, an annulus pressure crossover assembly 34, a control line sub 35 and first control fluid conduit 83 of the system 24.

Figure 5C:
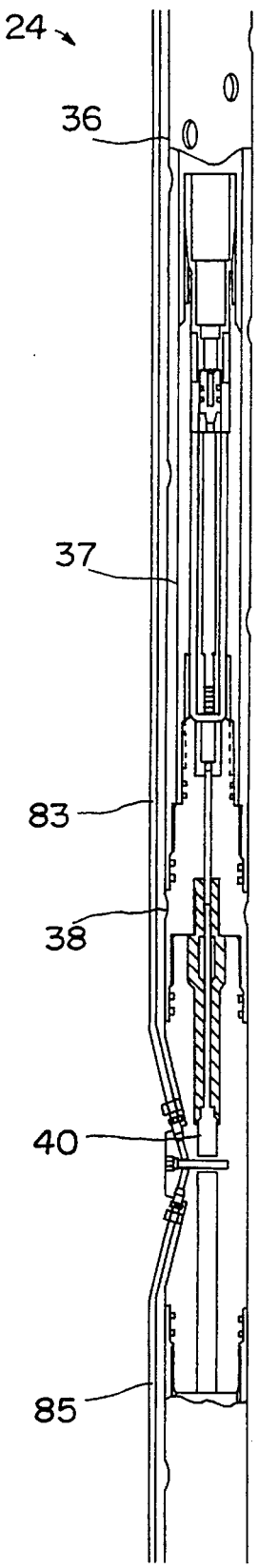
Figure 5D:
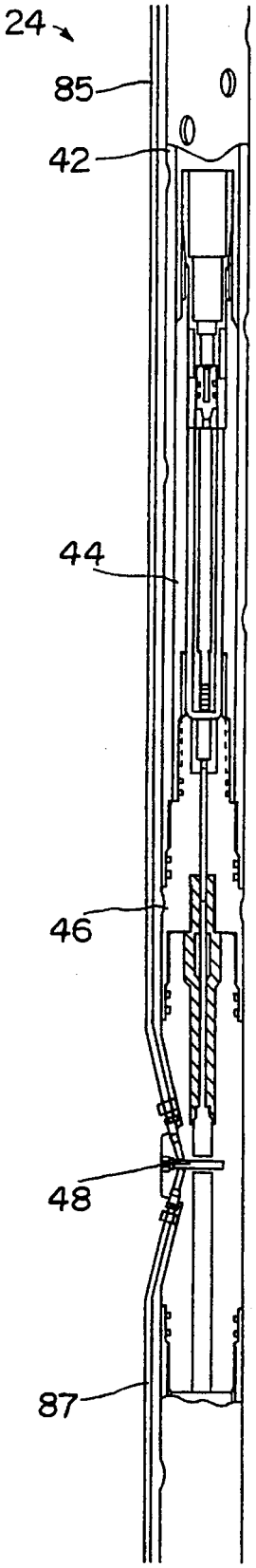
Figure 5E:
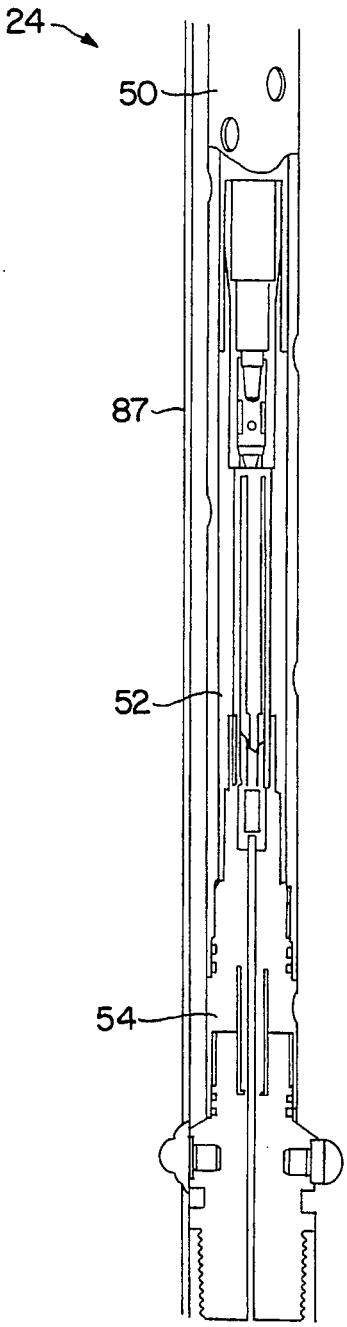

FIG. 5C depicts a first air chamber 36, a first pressure activated firing head 37, a first crossover 38, a first select fire sub 40, and first and second control fluid conduits 83 and 85 of system 24. A second air chamber 42, a second pressure activated firing head 44, a second crossover sub 46, a second select fire sub 48, and second and third control fluid conduits 85 and 87 are pictured in FIG. 5D. In FIG. 5E a third air chamber 50, a third pressure activated firing head 52, a third crossover sub 54, and third control fluid conduit 87 are depicted.

Figure 5F:
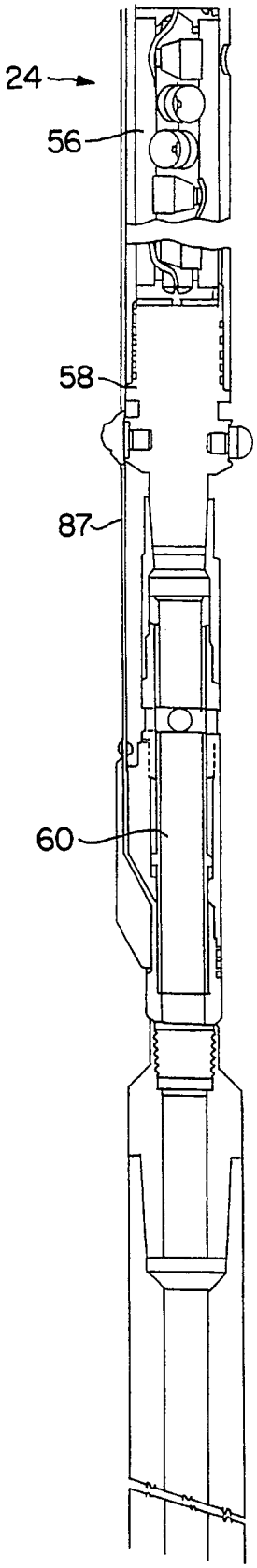
Figure 5G:
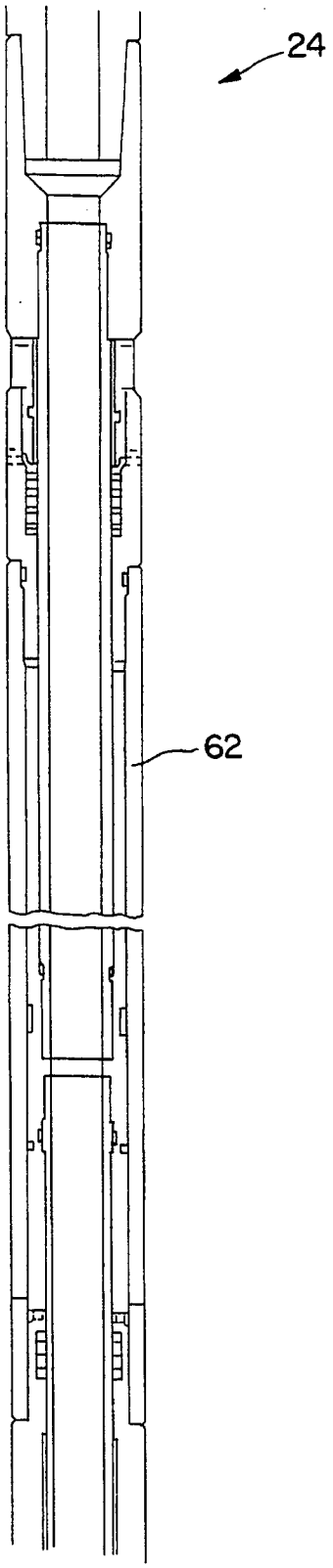
Figure 5H:
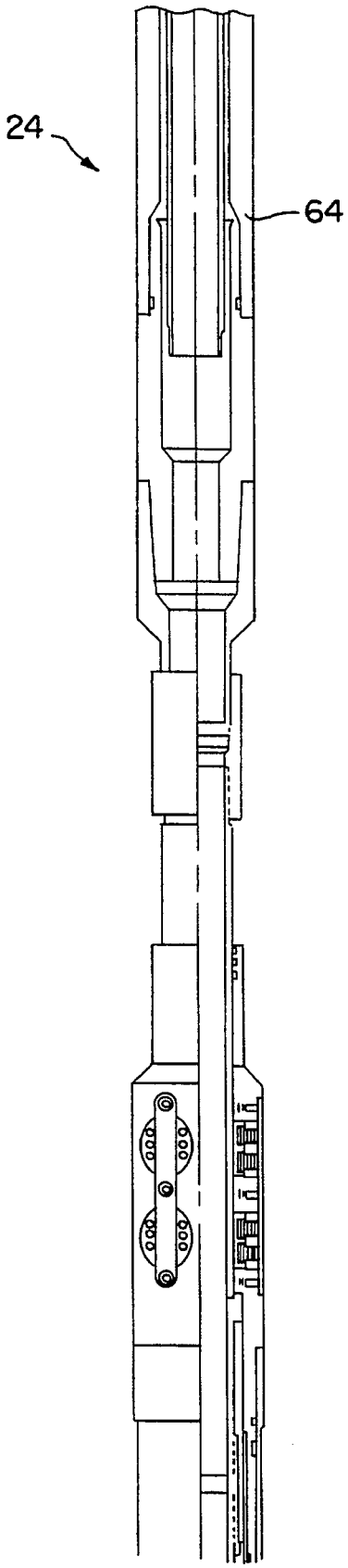
Figure 5I:
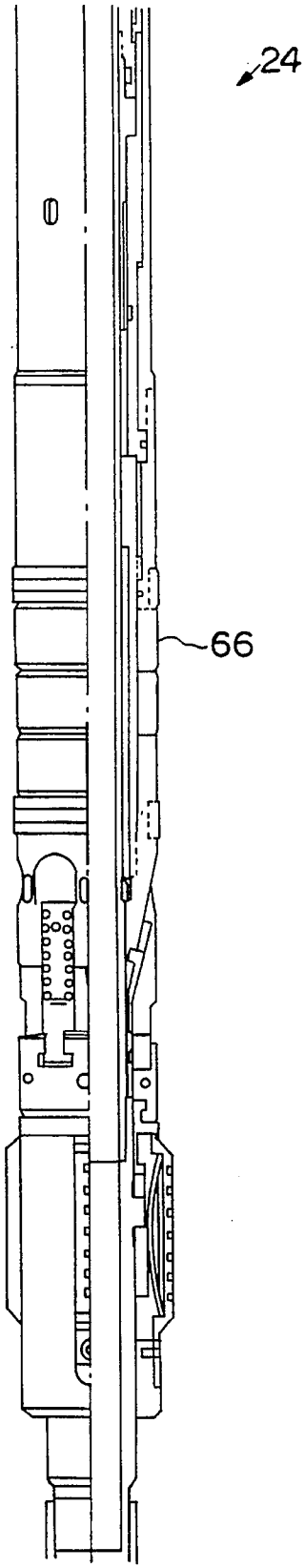
Figure 5J:
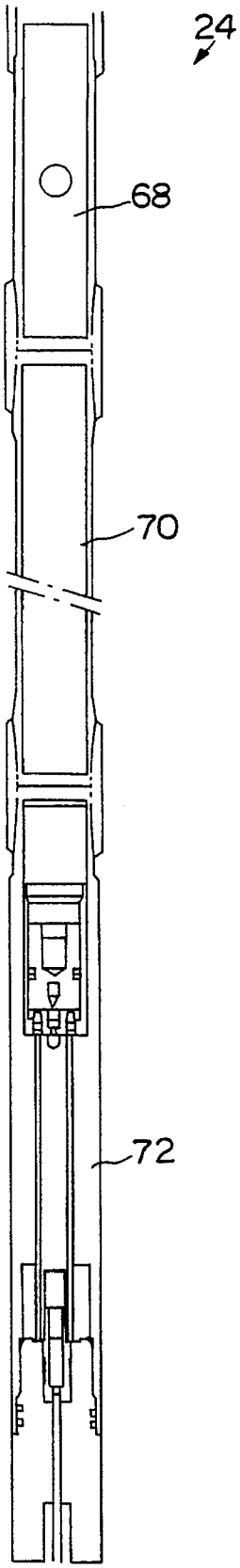
Figure 5K:
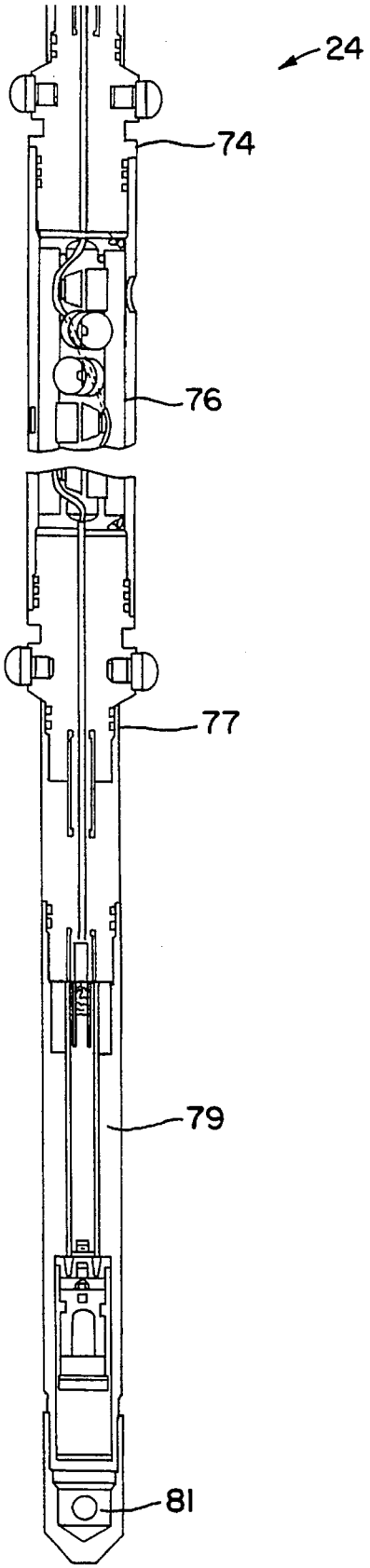

FIG. 5F shows a first perforating gun 56, a fourth solid crossover sub 87, a circulating valve 60, and third control fluid conduit of system 24. A slip joint 62 is depicted in FIG. 5G, a safety joint 64 is depicted in FIG. 5H and a second packer 66 is depicted in FIG. 5I. FIG. 5J shows a perforated sub 68, tubing 70, and a fourth pressure activated firing head 72. FIG. 5K shows a fifth crossover sub 74, a second perforating gun 76, a sixth crossover sub 77, a fifth pressure activated firing head 79, and a ported sub 81 of system 24.

OPERATION

The present invention can be further understood by reference to the previously disclosed detailed description and drawings in conjunction with the operation of the system. Set forth below is a preferred embodiment of the invention disclosing the operating procedures for the system.

In operation, the test string is run in the hole. After the test string is set for RTTS (retrievable treat test squeeze). By way of example, the system can be performed on a 1925 feet test well at Halliburton Energy Services North Test Well located in Carrollton, Tex. Next, the surface pressure is increased to 1200 psi to set the right hand (RH) packer, and the pressure is held for 5 minutes. To verify that the packer has been set, a pressure of 5000 psi is pulled.

The tubing pressure is continued up from 1175 psi to 2294 psi surface pressure to open the pressure operated vent (POV) and the pressure is subsequently released immediately while ensuring that the annulus valves are open. By way of example, the valve can be the 7-9-⅝" annulus valves. The 3-½-7 annulus is pressured to 1700 psi surface pressure and held to activate select tester to be ready for close-in. The tubing pressure is allowed to reduce to 829 psi surface pressure to fire the button time delay fire perforating guns. Then, the annulus is pumped down to simulate flow at ½ BPM.

Next, the pressure is bled on the 3-½-7" annulus to close select tester for closed-in time, while letting 7-9-⅝" annulus build up to 1000 psi to show closure. The 3-½-7" annulus is pressured to 1000 psi to cycle the Omni valve around the first well position. On the last pressure up cycle going into the well test, the surface pressure is continued to 1700 psi which opens the select tester and allowing the 7-9-⅝" annulus to flow at ½ BPM. In addition, surface pressure is continued up to 2577 psi to close a Vann Circulating Vent (VCV). This will isolate the bottom interval and fire either the No. 1 or 2 upper TDF's and lock the select tester open.

During the Drill String Testing (DST) of the lower perforated interval, the flow is coming into the drillstring through the open ports of the VCV. When the DST of the lower interval has been completed the VCV is caused to shut by applying the appropriate annulus pressure. This causes a sleeve in the VCV to seal across the open ports, and prevents any further flow from the lower interval into the drillstring. This is the first step in preparing for further DST of upper zones.

The 7-9-⅝" annulus is allowed to build pressure to 1000 psi to show the VCV closure. The system has an option to either bleed annulus off to 250 psi to monitor TDF firing or to maintain annulus pressure until all TDF's fire. If the first option is selected, pressure is applied to the annulus to 2500 psi to lock the select tester and fire remaining TDF's, making sure to hold pressure for 15 minutes. If closure is desired, release 3-½-7" annulus pressure and build back up to 2500 psi to unlock select tester and release back at 0 psi surface pressure for select tester closure. If, however, closure is not desired, simply release pressure on the 3-½-7" annulus.

Finally, pull a 28,000 psi pressure to release the RH packer. The tubing string is pulled to release the RTTS. The last step is pulling out of the hole.

The gun system for each zone to be perforated may be custom designed since the guns used to perforate the other zones will be isolated therefrom by a packer. This means there will not be constraints with respect to the length of the gun (or series of guns) or their distance from the isolating packer(s). This is not only a benefit over the other known systems, but also is a primary differentiating factor over the known prior art.

If all the gun systems are designed on the string to be properly located at one time (that is without having to move the string to orient the guns at the various zones), then each gun system may be actuated simultaneously, or in series. Because there are packers between each zone, different zones will not influence the others.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. A system for selectively perforating multiple zones in a well, comprising:

a tubing string;

at least a first and a second perforating gun carried on said tubing string, each said perforating gun having a pressure actuated firing head associated therewith;

a source of actuating fluid pressure for said firing heads;

at least a first and a second packer connected to said tubing string and associated with said first and second perforating guns such that said perforating guns are isolated with respect to the other; and at least a first and a second communication means for selectively actuating said pressure actuated firing heads to cause said perforating guns to perforate zones in a well.

2. A system of claim 1, wherein said second packer being positioned above said second perforating gun and said first packer being positioned between said first and said second perforating guns.

3. A system of claim 1, wherein said first and second communication means isolates said second firing head from said source of actuating fluid pressure until after said first firing head has been actuated and for then communicating said firing head with said source of actuating fluid pressure in response to actuation of said first firing head.

4. The system of claim 1, further comprising:

a total number X of said pressure actuated firing heads including said first and second firing heads; and a total number X-1 of said selective communication means including said first selective communication means.

5. The system of claim 3, wherein:

said first selective communication means includes a select fire sub including:

a housing having a first chamber defined therein communicated with said second firing head;

a supply passage communicated with said source of actuating fluid pressure and extending into said housing, said supply passage initially being isolated from said first chamber; and explosive means for perforating a portion of said housing and thereby communicating said supply passage with said first chamber.

6. The system of claim 5, wherein:

said housing of said select fire sub has a second chamber defined therein in addition to said first chamber, said chambers being initially separated by a wall; and said explosive means is disposed in said second chamber and is a means for perforating said wall.

7. The system of claim 6, wherein:

said supply passage extends into said wall, said wall being said portion of said housing perforated by said explosive means to communicate said supply passage with said first chamber.

8. The system of claim 5, further comprising:

actuating means for firing said explosive means of said select fire sub in response to firing of said first perforating gun.

9. The system of claim 5, wherein:

said source of actuating fluid pressure includes a well annulus surrounding said select fire sub, said supply passage being open to said well annulus; and said select fire sub is constructed so that when said explosive means perforates said portion of said housing, said first chamber is communicated with said well annulus.

10. An apparatus for isolating a plurality of perforating guns in a well, comprising:

a tubing string having the plurality of perforating guns connected thereto a predetermined location;

a plurality of packers connected to said tubing string and positioned above said corresponding perforating gun, said plurality of packers isolate said adjacent perforating guns from each other when positioned;

a pressure actuated firing head associated with each said perforating gun; and a source of actuating fluid for said firing heads which operates when pressurized to cause the firing heads to selectively fire the perforating guns.

11. An apparatus of claim 11, wherein the selective firing of the perforating guns is performed simultaneously.

12. An apparatus of claim 12, wherein the selective firing of the perforating guns is performed in series.

13. A method of perforating multiple zones in a well comprising the steps of:

(a) running into said well a tubing conveyed multiple zones perforating string including:

a tubing string;

at least a first and a second perforating guns carried by said tubing string;

at least a first and second pressure actuated firing head associated with said first and second perforating guns, respectively; and at least a first and a second packer connected to said tubing string and associated with said first and second perforating guns, said first packer being positioned above said first perforating gun and said second packer being positioned between said first and said second perforating guns;

(b) isolating said first and said second perforating guns by setting said first and said second packer in the well;

(c) firing said first and said second perforating guns by applying actuating fluid pressure from a source of actuating fluid pressure to said firing heads contained on said perforating guns.

14. A method of claim 13, wherein said firing of said first and said second perforating guns is performed simultaneously.

15. A method of claim 13, wherein said firing step of said second perforating gun is performed subsequent to said firing step of said first perforating gun.

16. A method of claim 14, wherein said firing step comprises the steps of:

(a) applying actuating fluid pressure from a source of actuating fluid pressure to said first firing head;

(b) isolating said second firing head from said source of said actuating fluid pressure during step (a);

(c) after step (a), firing said first perforating gun; and (d) in response to firing said first perforating gun in step (c), communicating said firing head with said source of said actuating fluid pressure.

17. The method of claim 16, further comprising:

between steps (a) and (c), bleeding off said actuating fluid pressure.

18. The method of claim 17, further comprising:

during step (d), isolating said second firing head from said first perforating gun.

19. The method of claim 17, further comprising:

applying actuating fluid pressure to said second firing head; and firing said second perforating gun.

20. The method of claim 19, further comprising:

firing said perforating guns sequentially from the bottom up, said first perforating gun being located below said second perforating gun.

21. The method of claim 19, further comprising:

firing said perforating guns sequentially from the top down, said first perforating gun being located above said second perforating gun.

22. The method of claim 17, wherein:

step (b) includes isolating said second firing head from said source of actuating fluid pressure with a wall; and step (d) includes detonating an explosive charge to perforate said wall and thereby communicate said second firing head with said source of actuating fluid pressure.

23. The method of claim 17, further comprising:

flow testing a subsurface zone perforated by said first perforating gun.

24. The method of claim 23, further comprising:

prior to step (c), isolating said subsurface zone between upper and lower packer elements carried by said tubing string.

25. The method of claim 16, further comprising the step of isolating the lower perforating guns to selectively test the drill string.

* * * * *